US009662767B2

(12) United States Patent
Abante et al.

(10) Patent No.: US 9,662,767 B2
(45) Date of Patent: May 30, 2017

(54) QUICK-CHANGE SANDING DRUM

(75) Inventors: Edward Abante, Chicago, IL (US); Roger Hajny, Cedarburg, WI (US); Kyle Jacobs, Appleton, WI (US)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 1523 days.

(21) Appl. No.: 13/336,872

(22) Filed: Dec. 23, 2011

(65) Prior Publication Data

US 2013/0165031 A1 Jun. 27, 2013

(51) Int. Cl.
*B24D 9/02* (2006.01)
*B24D 15/04* (2006.01)

(52) U.S. Cl.
CPC ..... *B24D 9/02* (2013.01); *B24D 15/04* (2013.01)

(58) Field of Classification Search
CPC ..... B24B 9/02; B24B 15/04
USPC ..... 451/296, 311, 355, 504, 507, 512, 513, 451/514, 517
See application file for complete search history.

(56) References Cited

U.S. PATENT DOCUMENTS

| | | | | | |
|---|---|---|---|---|---|
| 2,135,884 | A * | 11/1938 | Disco | 451/487 |
| 2,702,446 | A * | 2/1955 | Johnson | 451/507 |
| 2,734,321 | A * | 2/1956 | Field | 451/507 |
| 3,828,489 | A * | 8/1974 | Culley, Jr. | 451/507 |
| 4,546,576 | A * | 10/1985 | Dreiling | 451/504 |
| 4,555,199 | A * | 11/1985 | Maier et al. | 403/370 |
| 5,371,978 | A * | 12/1994 | Higashikawa | 451/51 |
| 5,672,096 | A * | 9/1997 | Amarosa et al. | 451/504 |
| 5,707,279 | A * | 1/1998 | Mitchell et al. | 451/512 |
| 6,203,410 | B1 * | 3/2001 | Tanaka et al. | 451/51 |
| 6,551,178 | B1 * | 4/2003 | Tanaka et al. | 451/180 |
| 6,780,084 | B2 * | 8/2004 | Moellenberg et al. | 451/5 |
| 6,835,124 | B2 * | 12/2004 | Stephan | 451/313 |
| 2004/0152405 | A1 * | 8/2004 | Stephan | 451/507 |
| 2010/0173572 | A1 * | 7/2010 | Good et al. | 451/464 |

FOREIGN PATENT DOCUMENTS

WO 2007113420 A1 10/2007

OTHER PUBLICATIONS

International Search Report and Written Opinion in corresponding PCT application (PCT/US2012/071551), mailed Jun. 12, 2013 (8 pages).

* cited by examiner

*Primary Examiner* — Eileen Morgan
(74) *Attorney, Agent, or Firm* — Maginot Moore & Beck LLP

(57) ABSTRACT

A sanding drum assembly in one embodiment includes at least one elastic friction member defining an outer perimeter, a plurality of feet located inwardly of the at least one elastic friction member, each of the plurality of feet including a movable portion movable between a first position whereat the plurality of feet define a first outermost circumference and a second position whereat the plurality of feet define a second outermost circumference, wherein the second outermost circumference is larger than the first outermost circumference, and an actuator, wherein the plurality of feet and the actuator are configured such that as the actuator and the plurality of feet change from a first configuration to a second configuration, the plurality of feet are forced from the first position to the second position.

20 Claims, 5 Drawing Sheets

QUICK-CHANGE SANDING DRUM

FIELD OF THE INVENTION

This patent relates generally to sanding drums which are driven by rotary tools.

BACKGROUND

Rotary tools, including drills, grinders, and routers, include a tool retainer or holder that non-rotatably secures a rotary bit (e.g., a cutting tool such as a drill bit or a router bit) to a drive shaft that is rotated by the rotary tool. One bit that has been developed for use in such rotary tools is a sanding drum bit. A sanding drum bit includes one end portion adapted for engagement with the bit holder and a second end portion which is adapted to support a closed loop sanding belt.

In order to mount the closed loop sanding belt on the sanding drum bit, the closed loop sanding belt must be somewhat larger in diameter than the mounting portion of the sanding drum bit. Configuring the closed loop sanding belt to fit onto the sanding drum bit in such a fashion, however, introduces the potential for the closed loop sanding belt to slip (radial relative movement) or creep (axial relative movement) on the sanding drum bit in use. Various approaches have been used to overcome this problem.

One approach used to minimize slip and creep is to minimize the difference in diameter between the closed loop sanding belt and the sanding drum bit mounting portion. Of course, as the mismatch is reduced, the difficulty in mounting the closed loop sanding belt on the sanding drum bit increases. In another approach, the frictional force between the sanding drum mounting portion and the sanding belt is increased by selecting high friction materials. For example, in some sanding drum bits, the mounting portion of the bit is made from a rubber material. This increases the amount of friction that must be overcome before creep or slip is realized. At the same time, the increased friction makes mounting of the closed loop sanding belt on the sanding drum bit mounting portion more difficult.

In some sanding drum bits, the mounting portion is configured to provide a variable diameter. In these devices, a rubber cylinder is compressed lengthwise, such as by using a screw and washer arrangement. As the length of the rubber cylinder is reduced, the diameter of the rubber cylinder is increased. Accordingly, a closed loop sanding belt can be mounted on the sanding drum bit with the rubber cylinder uncompressed. Once the closed loop sanding belt is mounted, the rubber cylinder is compressed to increase the friction between the closed loop sanding belt and the sanding drum bit. While effective, this approach can cause delay in changing between closed loop sanding belts. For example, a user must find a screwdriver to manipulate the screw and washer arrangement. Then, the screw and washer arrangement must be loosened to allow removal of a first closed loop sanding belt, and then tightened after a new closed loop sanding belt is positioned.

In another approach, some sanding drums have been constructed with recessed inset areas into which a sanding belt is snugly fitted. This approach is a costly modification since the sanding drum and sandpaper must be made with complementary non-planar surfaces. In addition, seating of the belt must be exact, otherwise slippage will be exacerbated.

What is needed is a sanding drum assembly that provides increased resistance to slip or creep. A further need exists for a sanding drum assembly that reduces the number of tools needed to replace sanding belts. Yet another need exists for a sanding drum assembly that allows for rapid replacement of sanding belts.

SUMMARY

In accordance with one embodiment of the disclosure, a sanding drum assembly includes at least one elastic friction member defining an outer perimeter, a plurality of feet located inwardly of the at least one elastic friction member, each of the plurality of feet including a movable portion movable between a first position whereat the plurality of feet define a first outermost circumference and a second position whereat the plurality of feet define a second outermost circumference, wherein the second outermost circumference is larger than the first outermost circumference, and an actuator, wherein the plurality of feet and the actuator are configured such that as the actuator and the plurality of feet change from a first configuration to a second configuration, the plurality of feet are forced from the first position to the second position.

In another embodiment, a sanding drum assembly includes a plurality of feet, the plurality of feet including a movable portion movable between a first configuration defining a first outermost circumference and a second configuration defining a second outermost circumference, wherein the second outermost circumference is larger than the first outermost circumference, at least one elastic friction member extending about the plurality of feet, the at least one elastic friction member expandable by the plurality of feet from a first outer perimeter to a second outer perimeter as the plurality of feet moves from the first configuration to the second configuration, and an actuator operably contacting an inner portion of the plurality of feet such that the actuator applies a force to the inner portion to force the plurality of feet from the first configuration to the second configuration.

DESCRIPTION

Figure 1:
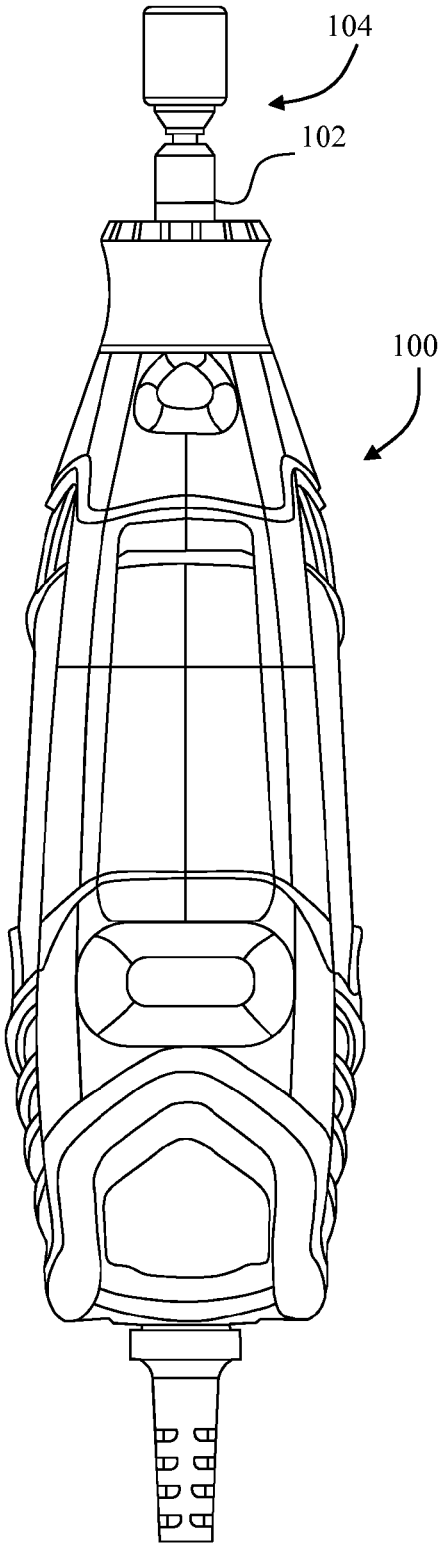
FIG. 1 depicts a side plan view of rotary tool with a sanding drum assembly in accordance with principles of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the invention includes any alterations and modifications to the illustrated embodiments and includes further applications of the principles of the invention as would normally occur to one skilled in the art to which this invention pertains.

Figure 2:
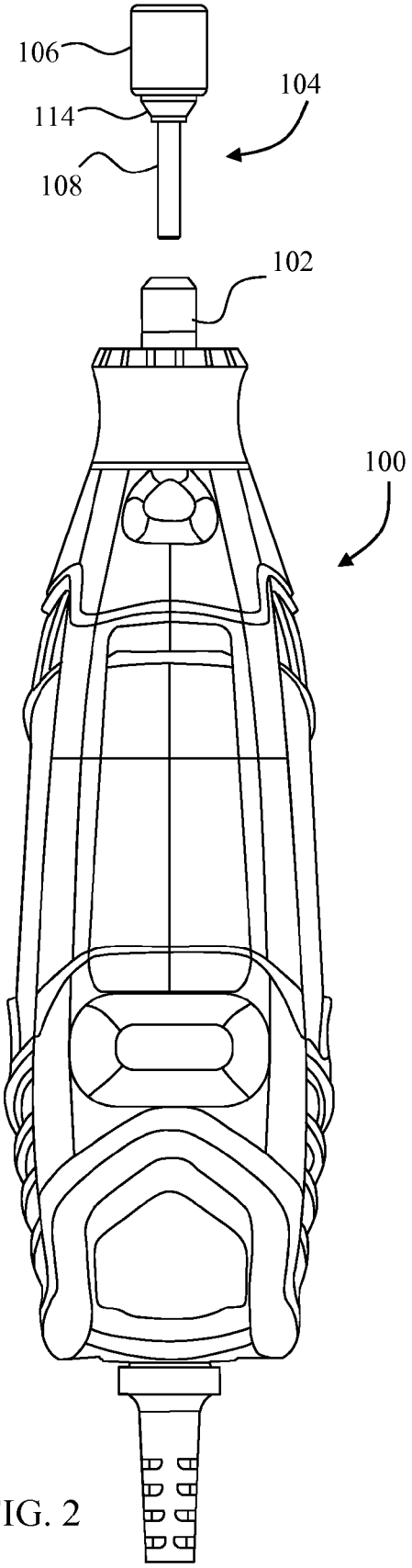
FIG. 2 depicts a side plan view of the sanding drum assembly of FIG. 1 aligned with the bit holder of the rotary tool of FIG. 1.
Figure 3:
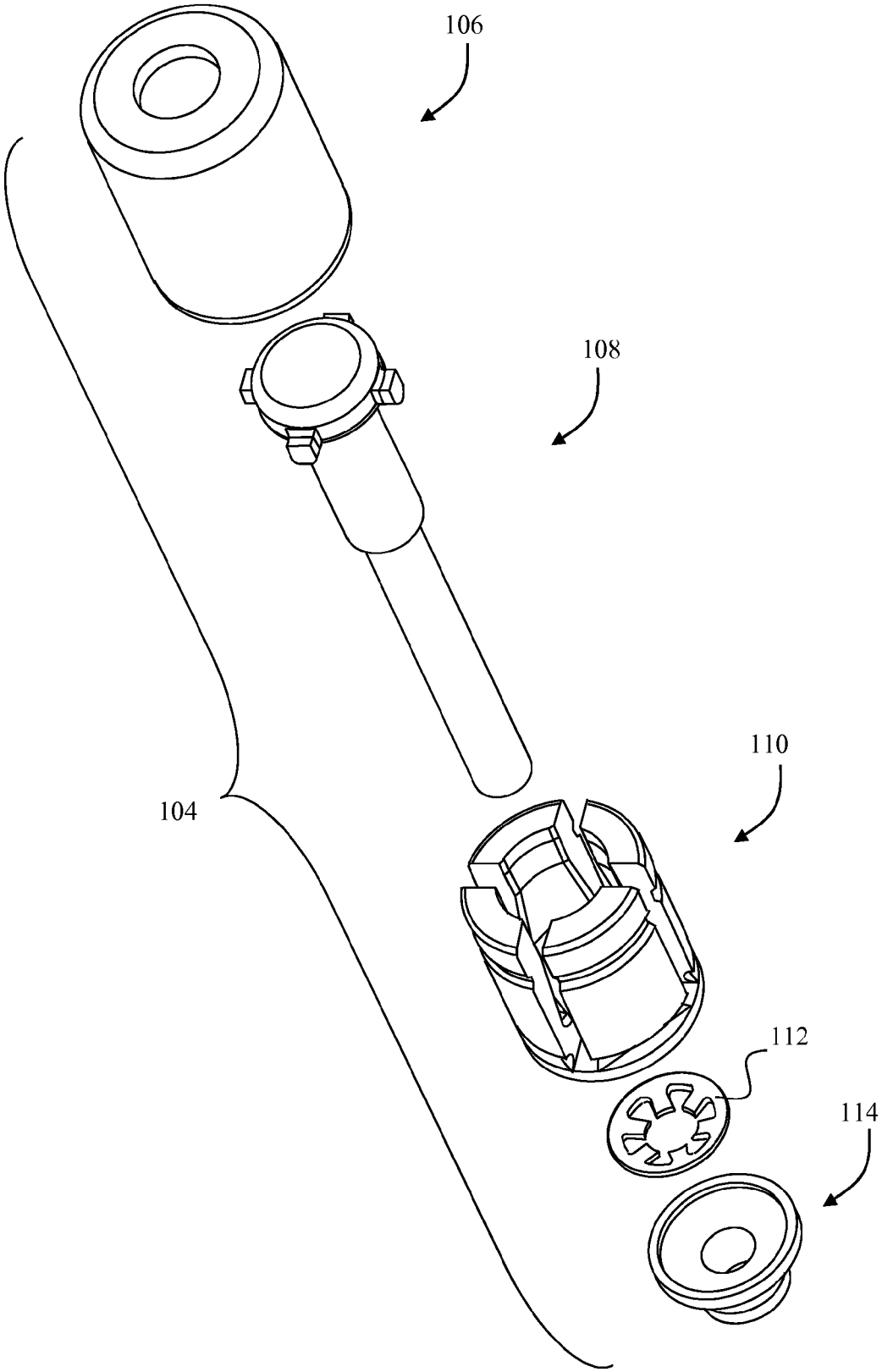
FIG. 3 depicts an exploded perspective view of the assembly of FIG. 1.
Figure 4:
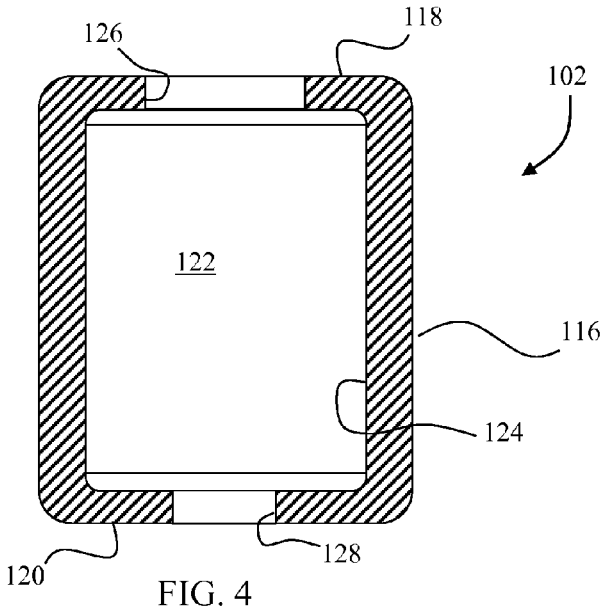
FIG. 4 depicts a side cross sectional view of the cylindrical elastic friction member of the sanding drum assembly of FIG. 1.

FIG. 1 depicts a rotary tool 100 including a bit holder 102. A sanding drum assembly 104 is shown in FIG. 1 mounted in the bit holder 102 while in FIG. 2 the sanding drum assembly 104 is aligned with the bit holder 102. As further shown in FIG. 3, the sanding drum assembly 104 includes an elastic friction member 106, a mandrel 108, a bushing 110, a lock washer 112, and a collar 114. The elastic friction member 106, shown in additional detail in FIG. 4, is cylindrical in shape and includes an outer wall 116, an upper end portion 118, and a lower end portion 120. The elastic friction member 106 is hollow and includes a receiving area 122 defined by an inner wall 124. An opening 126 extends from the receiving area 122 through the upper end portion 118 while an opening 128 extends from the receiving area 122 through the lower end portion 120

Figure 5:
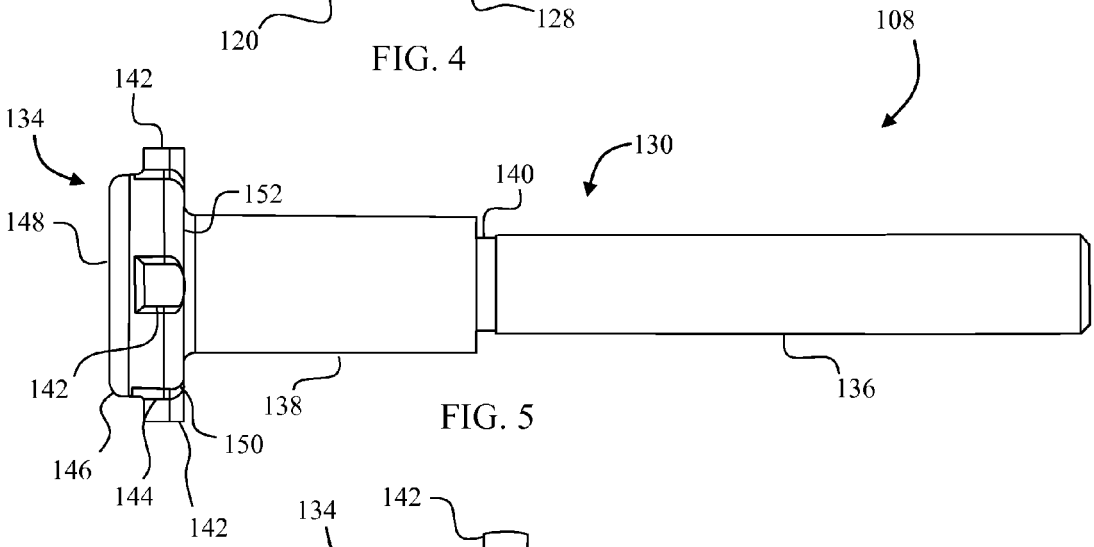
FIG. 5 depicts a side plan view of the actuator of the sanding drum assembly of FIG. 1.
Figure 6:
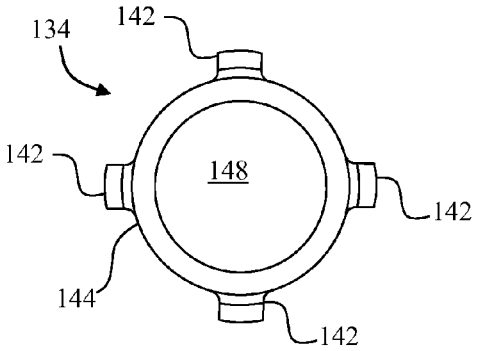
FIG. 6 depicts a top plan view of the actuator of the sanding drum assembly of FIG. 1.

The mandrel 108, also shown in FIGS. 5 and 6, includes a shaft portion 130 and a head portion 134. The shaft portion 130 includes a coupling portion 136 and a throat portion 138. A notch 140 joins the coupling portion 136 and the throat portion 138. The head portion 134 includes four tabs 142 which extend outwardly from a sidewall 144 of the head portion 134. An upper rounded shoulder 146 extends between the side wall 144 and an upper surface 148 of the head portion 134 while a lower rounded shoulder 150 extends between the side wall 144 and a lower surface 152 of the head portion 134.

Figure 7:
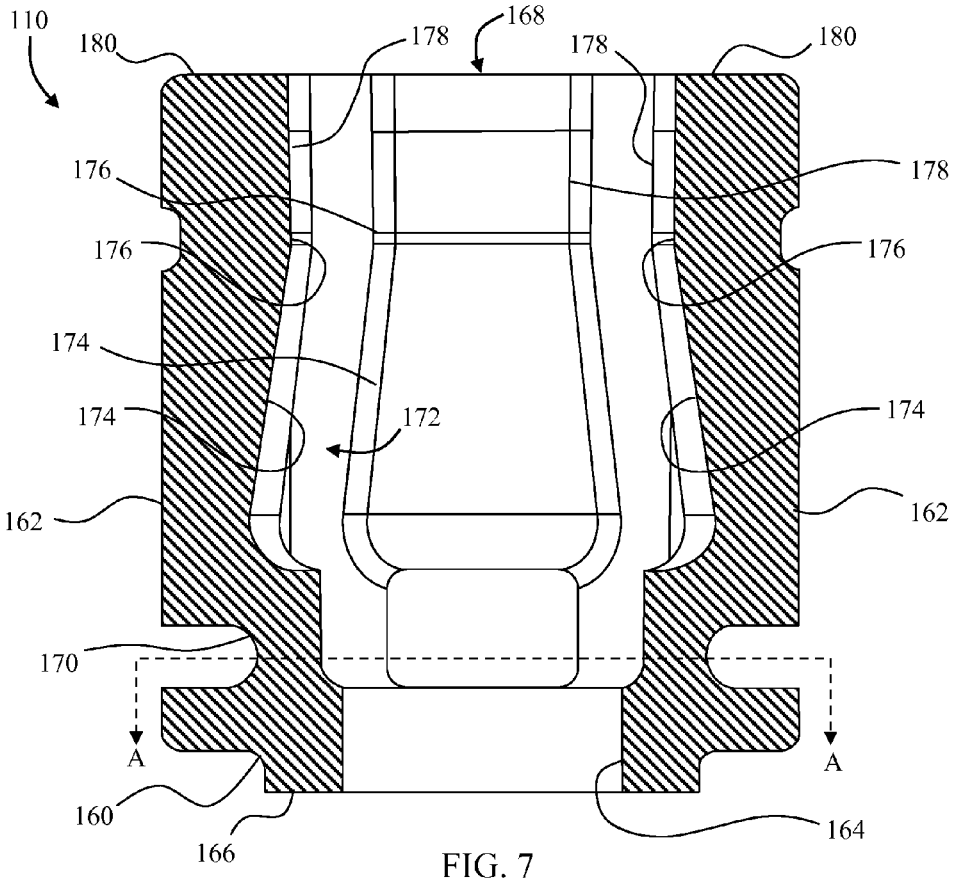
FIG. 7 depicts a side cross sectional view of the bushing member of the sanding drum assembly of FIG. 1.
Figure 8:
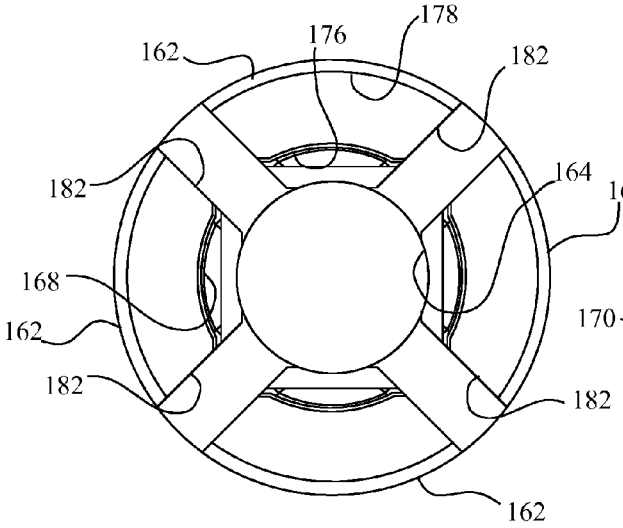
FIG. 8 depicts a top plan view of the bushing member of the sanding drum assembly of FIG. 1.
Figure 9:
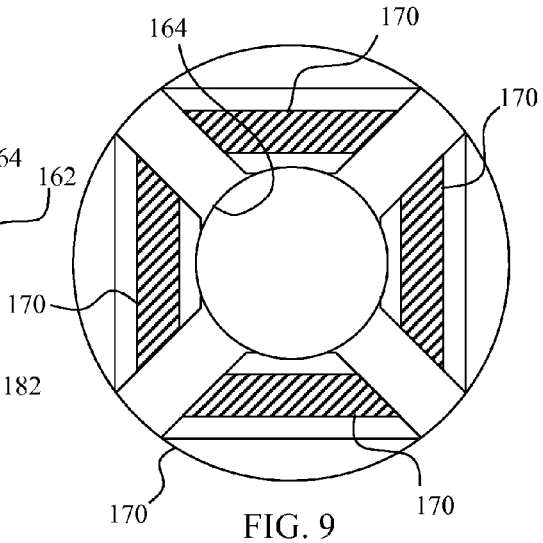
FIG. 9 depicts a top cross sectional view of the bushing member of the sanding drum assembly of FIG. 1 taken along the line A-A of FIG. 7.

Referring now to FIGS. 7-9, the bushing 110 includes a base portion 160 and four feet 162. A bore 164 extends through the base portion 160 from a lower surface 166 of the bushing 110 to an actuation chamber 168 generally defined by the feet 162. Each of the feet 162 are joined to the base portion 160 by a hinge 170. An inner portion 172 of each of the feet 162 includes a lower foot portion 174 that extends upwardly and inwardly from the hinge 170 to a neck portion 176. The neck portions 176 define a reduced diameter portion of the actuation chamber 168. Above the neck portion 176, an upper foot portion 178 extends upwardly and outwardly from the neck portion 174 to an upper surface 180. Each of the feet 162 are separated from adjacent feet 162 by guide slots 182.

Assembly of the sanding drum assembly 104 is described with reference to FIGS. 5 and 7. Initially, the coupling portion 136 of the mandrel 108 is aligned with the actuation chamber 168 and then inserting the coupling portion 136 through the actuation chamber 168 and the bore 164 in the base portion 160 of the bushing 110. Continued movement of the mandrel 108 brings the head portion 134 adjacent to the upper foot portions 178 of the feet 162.

The head portion 134 is shaped complementary to the inner portion 172 in that both are generally circular. The head portion 134, however, has a maximum diameter that is larger than the diameter of the portion of the actuation chamber 168 that is defined by the upper foot portions 178. In one embodiment, the maximum diameter of the head portion 134 is about 7 millimeters (mm) while the diameter of the actuation chamber 168 at the upper surface 180 of the bushing 110 is about 6.29 mm. Accordingly, the head portion 134 comes into contact with the upper foot portions 178 as the mandrel 108 is moved through the actuation chamber 168. The bushing 110, however, is made of a plastic material. Accordingly, by aligning the tabs 142 with the guide slots 182 and applying pressure to the upper foot portions 178 with the head portion 134, the feet 162 are pivoted about the hinges 170 in a radially outwardly direction, allowing the head portion 134 to enter into the actuation chamber 168 as the tabs 142 enter into a respective one of the guide slots 182. Other materials which provide or can be modified to provide sufficient rigidity and flexibility for the functions described herein may be used.

The neck portions 176 define a diameter of about 6.15 mm in a relaxed condition, while the lower foot portions 174 define at diameter of about 7.49 mm at a location adjacent to the base portion 160. Accordingly, once the head portion 134 moves past the neck portions 176, the feet 162 begin to move inwardly until they reach a relaxed position with the head portion 134 adjacent to the base portion 160. At this point, the throat portion 138 of the mandrel 108, which is about 4.4 mm in diameter, extends through the bore 164, which is about 4.5 mm in diameter, and the tabs 142 are positioned within a respective one of the guide slots 182. The guide slots 182 have a width of about 1.5 mm to accommodate the tabs 142 which have a width of about 1.4 mm.

Next, the opening 126 in the elastic friction member 106 (see FIG. 4) is aligned with the shaft portion 130 of the mandrel 108 and the coupling portion 136 of the mandrel 108 is inserted through the opening 126, through the receiving area 122, and out the opening 128. The diameter of the coupling portion 136 in one embodiment is about 3.18 mm while the diameter of the opening 128 is about 3.1 mm. The elastic friction member 106, however, is made of a rubber material and can be deformed so as to allow the coupling portion 136 through the opening 128. Other materials such as elastomers or fluoroelastomers which provide or can be modified to provide sufficient elasticity and friction for the functions described herein may be used.

Continued movement of the mandrel 108 through the elastic friction member 106 brings the upper end portion 118 of the elastic friction member 106 next to the lower surface 166 of the bushing 110. The diameter of the base portion 160, and of the feet 162 in a relaxed state, is about 10.25 mm while the diameter of the opening 126 is about 4.8 mm. Accordingly, the rubber material of the elastic friction member 106 must be stretched to allow the bushing 110 to move past the base portion 160 and along the feet 162. Additionally, the opening 128 is further stretched to fit over the throat portion 138.

The bushing 110 is thus inserted into the receiving area 122. The inner dimensions of the receiving area 122 prior to insertion of the bushing 110 into the receiving area 122 are about 8.4 mm in diameter and about 11.5 mm in height. The outer dimensions of the bushing 110 are about 10.25 mm in diameter and about 11.5 mm in height. Accordingly, the elastic friction member 106 is slightly extended, primarily in a radial direction, once the bushing 110 is inserted into the receiving area 122.

Assembly of the sanding drum assembly 104 is completed by insertion of the coupling portion 136 of the mandrel 108 through the lock washer 112 which is pushed up the coupling portion 136 until the lock washer 112 seats in the notch 140. Then, the collar 114 is pushed along the coupling portion 136 until it receives the lock washer 112 in a hollow portion of the collar 114 thereby locking the collar 114 to the mandrel 108.

Figure 10:
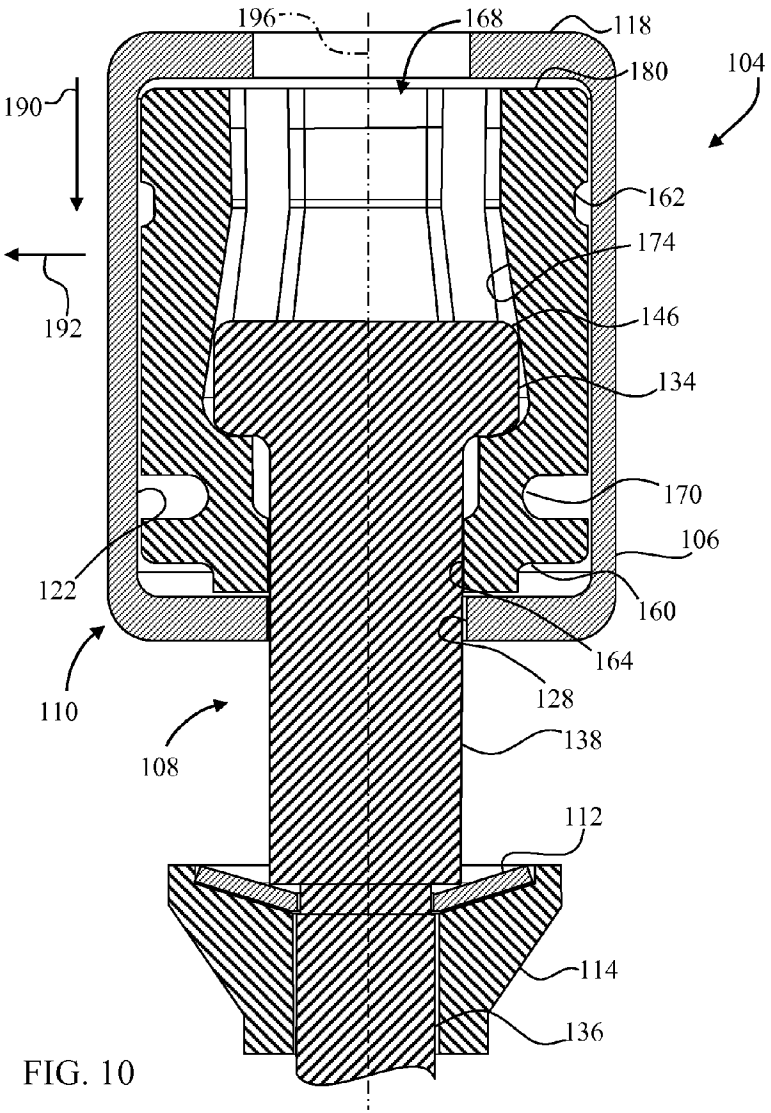
FIG. 10 depicts a side cross sectional view of the sanding drum assembly of FIG. 1 in the unlocked configuration.

The resulting configuration of the sanding drum assembly 104 is as depicted in FIG. 10. In FIG. 10, the collar 114 is locked to the mandrel 108 by the locking washer 112. The bushing 110 is located within the receiving area 122 with the head 134 of the mandrel 108 positioned within the actuation chamber 168 adjacent to the base portion 160. Additionally, the throat portion 138 of the mandrel 108 extends through the bore 164 in the base portion 160 and through the opening 128 in the elastic friction member 106. The coupling portion 136 may be coupled with the rotary tool 100 (FIGS. 1 and 2) to prepare the sanding drum assembly 104 for use.

In the configuration of FIG. 10, a sandpaper belt (not shown) can be quickly secured to the sanding drum assembly 104 by positioning the sandpaper belt around the elastic friction member 106. Preferably, the sandpaper belt has an inner diameter that is either the same diameter as the assembled sanding drum assembly 104 or just slightly larger than the sanding drum assembly 104. The guide slots 182 and hinges 170 allow for some amount of compression of the sanding drum assembly 104 to assist in positioning the sandpaper belt on the elastic friction member 106.

The sandpaper belt is then secured by applying force to the upper end portion 118 of the elastic friction member 106 as indicated by the arrow 190 of FIG. 10. The applied pressure is transferred to the upper surface 180 of the feet 162 of the bushing 110 forcing the bushing 110 in the direction of the arrow 190. The downward force presses the lower foot portion 174 of the bushing 110 against the rounded upper shoulder 146 of the mandrel 108 resulting in a radially outward pressure on the feet 162 as indicated by the arrow 192. Because the feet 162 are hingedly attached to the base portion 160 by the hinges 170, the outward pressure causes each of the feet 162 to move radially outward away from an axis 196 defined by the mandrel 108. The outward movement of the feet 162 increases the diameter of the actuation chamber 168, thereby allowing the bushing 110, the elastic friction member 106, and the sandpaper belt (not shown) to move in the direction of the arrow 190.

Figure 11:
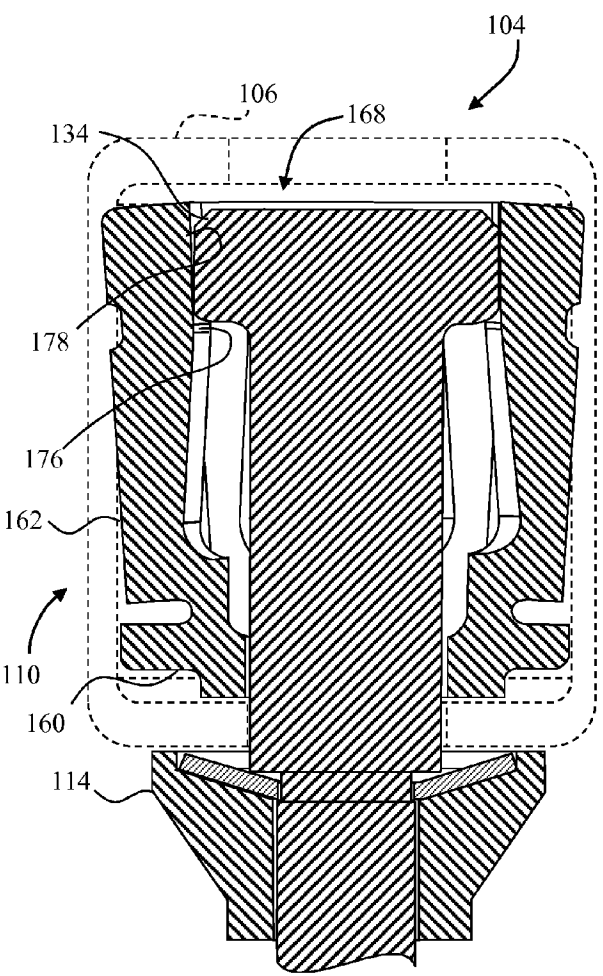
FIG. 11 depicts a side cross sectional view of the sanding drum assembly of FIG. 1 in the locked configuration without the elastic friction member but with the unlocked configuration of the elastic friction member depicted in shadow to show the increased diameter of the sanding drum assembly in the locked configuration.

The foregoing process continues until the elastic friction member 106 comes into contact with the collar 114 (see FIG. 11). At this point, the sandpaper belt is securely held by the sanding drum assembly 104 as explained with continued reference to FIG. 11. In FIG. 11, the elastic friction member 106 is depicted in shadow in the size and shape of the elastic friction member 106 in the unlocked condition of FIG. 10. The rest of the sanding drum assembly 104 is depicted in the locked configuration which results from pressing the elastic friction member 106 in the direction of the arrow 190 as described above.

In the locked condition, the head portion 134 of the mandrel 108 is located above the neck portion 176 of the bushing 110. Accordingly, the relative slope between the upper foot portions 178 and the head portion 134 under the elastic pressure applied by the elastic friction member 106 tend to force the bushing 110 toward the collar 114, thereby maintaining the elastic friction member 106 seated against the collar 114.

Additionally, because the diameter of the head portion 134 is larger than the diameter of the actuation chamber 168 defined by the upper foot portions 178 in a relaxed condition (see FIG. 10), the feet 162 are maintained in a location that is radially outward of the location of the feet 162 in the unlocked position of FIG. 10. Thus, the outer circumference of the feet 162 defines a larger circumference in the locked condition of FIG. 11. This is evident by the movement of the upper portion of the feet 162 into the area formerly occupied by the elastic friction member 106 as depicted by the overlying portion of the feet 162 with the shadowed depiction of the elastic friction member 106 in FIG. 11. The increased diameter of the sanding drum assembly 104 provides an increased frictional hold between the elastic friction member 106 and the sandpaper belt.

The sanding drum assembly 104 may be easily unlocked by a user to facilitate replacement of a sandpaper belt simply by applying pressure at the base portion 160 of the bushing 110 so as to force the bushing 110 away from the collar 114. This reverses the sequence described above, returning the sanding drum assembly 104 to the unlocked configuration of FIG. 10.

The present invention has been described above with respect to a particular embodiment. In other embodiments, various dimensions may be modified for a particular application. Additionally, while the components where described with reference to a specific embodiment, various structural features of the sanding drum assembly 104 may be modified in other embodiments of the invention. By way of example, the elastic friction member was described above as being a single substantially cylindrical component. In other embodiments, an elastic friction member may be provided in the form of a band which fits around the feet. One such friction member is realized in the form of an o-ring. If desired, a number of band-like elastic friction members may be used. Furthermore, in some embodiments, the outer surface of the feet may be provided with a groove or similar indentation to receive the elastic friction member.

Moreover, while the feet 162 were hingedly attached to a base portion 160 in the foregoing example, other forms of feet members may be used in a sanding drum assembly in accordance with the invention. In one embodiment, the feet are not connected to each other or to a base portion. In these embodiments, the elastic friction member(s) maintain the feet about the actuator.

Consequently, while the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

The invention claimed is:

1. A sanding drum assembly comprising:

at least one elastic friction member defining an outer perimeter;

a plurality of feet located inwardly of the at least one elastic friction member, each of the plurality of feet extending along an axis from a lower foot portion to a movable upper foot portion movable between a first position whereat the upper foot portions of the plurality of feet define a first circumference radially outwardly from the axis and a second position whereat the upper foot portions of the plurality of feet define a second outermost circumference of the plurality of feet radially outwardly from the first circumference; and an actuator having a cylindrical head portion having a sidewall parallel to a longitudinal axis of the actuator, wherein the plurality of feet and the actuator side wall are configured such that as the actuator side wall and the plurality of feet change from a first configuration to a second configuration, the plurality of feet are forced via the actuator from the first position to the second position such that the upper foot portions of the plurality of feet are forced farther outwardly than the lower foot portions of the plurality of feet, wherein in the first configuration the lower foot portions substantially define a first maximum diameter and the upper foot portions substantially define a first minimum diameter, and the first maximum diameter is greater than the first minimum diameter.

2. The sanding drum assembly of claim 1, wherein:

the relative position of the actuator and the plurality of feet is changeable along the axis.

3. The sanding drum assembly of claim 2, further comprising:

a base portion, wherein the plurality of feet extend upwardly from the base position and the lower foot portion of each of the plurality of feet is hingedly attached to the base portion.

4. The sanding drum assembly of claim 3, wherein:

the base portion includes a central bore; and the actuator includes a shaft portion extending completely through the central bore.

5. The sanding drum assembly of claim 4, wherein the cylindrical head portion has:

a maximum diameter larger than a maximum diameter of the shaft portion and located inwardly of the plurality of feet; and at least one tab, wherein the sanding drum assembly is configured such that a respective tab of the at least one tab is interleaved between each adjacent foot of the plurality of feet.

6. The sanding drum assembly of claim 4, wherein:

each of the lower foot portions extend upwardly and inwardly from the base portion to a respective neck portion; and each of the upper foot portions extend upwardly and outwardly from the respective neck portion; and a second minimum diameter defined by the lower foot portions is greater than a maximum diameter defined by the shaft portion.

7. The sanding drum assembly of claim 6, wherein:

the base portion, the lower foot portions, the neck portions, and the upper foot portions define a bushing height;

the at least one elastic friction member defines an elastic friction member height; and the elastic friction member height is greater than the bushing height.

8. The sanding drum assembly of claim 1, wherein the plurality of feet are contained within the at least one elastic friction member by radially extending portions of the at least one elastic friction member.

9. The sanding drum assembly of claim 3, wherein the at least one elastic friction member includes a lower end portion extending radially inwardly to a location underneath the lower portions of the plurality of feet.

10. The sanding drum assembly of claim 4, wherein the at least one elastic friction member comprises:

a lower end portion extending radially inwardly to a location underneath the lower portions of the plurality of feet; and an opening in the lower end portion sized to receive the shaft therethrough.

11. A sanding drum assembly comprising:

a base portion;

a plurality of feet extending upwardly from the base portion along an axis, each of the plurality of feet including a lower foot portion and a movable upper foot portion above the base portion, the plurality of feet movable between a first configuration whereat the upper foot portions define a first outermost circumference radially outwardly from the axis and a second configuration whereat the upper foot portions define a second outermost circumference radially outwardly from the axis, wherein the second outermost circumference is larger than the first outermost circumference;

at least one elastic friction member extending about the plurality of feet, the at least one elastic friction member expandable by the plurality of feet from a first outer perimeter to a second outer perimeter as the plurality of feet moves from the first configuration to the second configuration; and an actuator having a cylindrical head portion having a sidewall parallel to a longitudinal axis of the actuator and operably contacting an inner portion of each of the plurality of feet such that the actuator side wall applies a force to the inner portions to force the plurality of feet from the first configuration to the second configuration, wherein in the first configuration the lower foot portions substantially define a first maximum diameter and the upper foot portions substantially define a first minimum diameter, and the first maximum diameter is greater than the first minimum diameter.

12. The sanding drum assembly of claim 11, wherein a bushing comprises:

the plurality of feet; and the base portion, wherein the base portion is operably connected to each of the plurality of feet.

13. The sanding drum assembly of claim 12, wherein each of the lower foot portions extend upwardly and inwardly from the base portion to a neck portion; and each of the upper foot portions extend upwardly and outwardly from the neck portion.

14. The sanding drum assembly of claim 13, wherein the base portion is hingedly attached to each of the plurality of feet such that the upper foot portions of the plurality of feet are forced farther outwardly than the lower foot portions of the plurality of feet when the plurality of feet move from the first configuration to the second configuration.

15. The sanding drum assembly of claim 14, wherein:

the base portion includes a central bore; and the actuator includes a shaft portion extending completely through the central bore.

16. The sanding drum assembly of claim 15, wherein the bushing is contained within the at least one elastic friction member by radially extending portions of the at least one elastic friction member.

17. The sanding drum assembly of claim 11, wherein:

the relative position of the actuator and the plurality of feet is changeable along the axis.

18. The sanding drum assembly of claim 16, wherein the plurality of feet comprises two adjacent feet and the actuator further comprises:

a tab interleaved between the two adjacent feet.

19. The sanding drum assembly of claim 11, wherein the at least one elastic friction member includes a lower end portion extending radially inwardly to a location underneath the base portion.

20. The sanding drum assembly of claim 19, wherein the at least one elastic friction member comprises:

an opening in the lower end portion sized to receive a shaft portion of the actuator therethrough.

* * * * *